US005308411A

United States Patent [19]

Suga et al.

[11] Patent Number: 5,308,411

[45] Date of Patent: May 3, 1994

[54] ULTRAHIGH SILICON, GRAIN-ORIENTED ELECTRICAL STEEL SHEET AND PROCES FOR PRODUCING THE SAME

[75] Inventors: Yozo Suga; Yoshiyuki Ushigami; Hodaka Honma; Nobuyuki Takahashi, all of Kitakyushu, Japan

[73] Assignee: Nippon Steel Corporation, Tokyo, Japan

[21] Appl. No.: 835,982

[22] PCT Filed: Jun. 20, 1991

[86] PCT No.: PCT/JP91/00829

§ 371 Date: Feb. 20, 1992

§ 102(e) Date: Feb. 20, 1992

[87] PCT Pub. No.: WO91/19825

PCT Pub. Date: Dec. 26, 1991

[30] Foreign Application Priority Data

Jun. 20, 1990 [JP] Japan ..... 2-162244

[51] Int. Cl.[5] ..... H01F 1/04

[52] U.S. Cl. ..... 148/113; 148/111; 148/308

[58] Field of Search ..... 148/111, 113, 308; 420/117

[56] References Cited

U.S. PATENT DOCUMENTS 5,082,509 1/1992 Ushigami et al. ..... 148/111

FOREIGN PATENT DOCUMENTS 0392534 10/1990 European Pat. Off. ..... 148/111
1381322 11/1964 France .
56-13433 2/1981 Japan .
60-33860 2/1985 Japan .
61-60896 12/1986 Japan .
62-45285 9/1987 Japan .
62-274047 11/1987 Japan .
62-287043 12/1987 Japan .
2-259016 10/1990 Japan .
870870 6/1961 United Kingdom .
923678 4/1963 United Kingdom .

OTHER PUBLICATIONS

Data Base WPIL, Week 9048, Derwent Publications Ltd., GB, AN 90-358380.
European Search Report, EP 91 91 1311.
J. Appl. Phys. vol. 64, No. 10 (1988) pp. 5367-5369 "Commercial Scale Production of Fe-6.5 wt % Si Sheet", Y. Takada et al.
International Search Report PCT/JP91/00829.

*Primary Examiner*—John P. Sheehan
*Attorney, Agent, or Firm*—Kenyon & Kenyon

[57] ABSTRACT

An ultrahigh silicon, grain-oriented electrical steel sheet having a magnetic flux density, $B_8$, of 1.57 or more and a degree of azimuth orientation, R ($B_8/B_s$) of 0.87 or more is provided by cold-rolling an ultrahigh silicon steel sheet comprising by weight 0.005 to 0.023% of C, 5 to 7.1% of Si, 0.014% or less of S, 0.013 to 0.055% of acid soluble Al and 0.0095% or less of total N with the balance consisting of Fe and unavoidable impurities at a temperature in the range of from 120° to 380° C. optionally after annealing at a temperature in the range of from 800° to 1100° C., subjecting the cold-rolled sheet to decarburization annealing, coating the annealed sheet with an annealing separator, coiling the coated sheet to prepare a strip coil and subjecting the strip coil to high-temperature finish annealing for secondary recrystallization, the steel sheet being subjected to nitriding during a period from the decarburization annealing to the initiation of secondary recrystallization in the step of high-temperature finish annealing, to increase the nitrogen content.

4 Claims, 2 Drawing Sheets

ULTRAHIGH SILICON, GRAIN-ORIENTED ELECTRICAL STEEL SHEET AND PROCES FOR PRODUCING THE SAME

DESCRIPTION

1. Technical Field

The present invention relates to a grain-oriented electrical steel sheet having a high silicon content and a process for producing the same, and particularly to a soft magnetic material having a Si content of 5 to 7.1% and exceptional magnetic properties unattainable in the prior art and a process for producing the same.

2. Background Art

A grain-oriented electrical steel sheet comprises a crystal grain having a {110} plane in the steel sheet plane and <001> in the direction of rolling, that is, the so-called Goss orientation (expressed as a {110 } <001> orientation in the Miller indices), and is used as a soft magnetic material in an iron core for transformers and large size rotating machines such as a generator. This steel sheet should have good magnetizing and iron loss properties with respect to the magnetic properties. Whether the magnetizing property is good or bad is determined by the height of the magnetic flux density induced within an iron core under an applied given magnetic force. An increase in the magnetic flux density of a soft magnetic material (a grain-oriented electrical steel sheet) can be attained by controlling the orientation of the crystal grain of the steel sheet into {110} <001> orientation to a high degree.

The iron loss is a power loss consumed as heat energy when a predetermined alternating current magnetic field is applied to an iron core. The iron loss property of the grain-oriented electrical steel sheet is influenced by the magnetic flux density, sheet thickness, amount of impurities, specific resistance, size of crystal grain, etc. The grain-oriented electrical steel sheet having a high magnetic flux density (usually expressed in terms of $B_8$ value) enables the size of electrical equipment to be reduced and exhibits a low (good) iron loss, so that an effort has been made in the art to enhance the magnetic flux density of the grain-oriented electrical steel sheet.

The grain-oriented electrical steel sheet is produced through the so-called "secondary recrystallization" wherein a steel sheet subjected to a proper combination of hot rolling, cold rolling and annealing to have a final thickness is subjected to finish annealing at a high temperature to selectively grow a primary recrystallized grain having a {110 } <001> orientation.

The secondary recrystallization is attained when the following requirements are satisfied.

a) Fine precipitates, for example, MnS, AIN and MnSe, or intergranular elements, such as Sn, Sb and P, are present in a steel sheet before secondary recrystallization (these substances are called an "inhibitor").

b) The primary recrystallized grain structure is a proper one, which means, the crystal grains are homogeneous and the texture is one wherein a grain having a {110 } <001> orientation easily grows.

In the above-mentioned process for producing a grain-oriented electrical steel sheet, a technique which enables a product having a particularly high magnetic flux density to be produced is disclosed in Japanese Examined Patent Publication (Kokoku) No. 40-15644 by Taguchi and Sakakura. This technique is characterized in that AIN precipitated in a $\alpha \rightarrow \gamma$ transformation is utilized as an inhibitor and this AIN precipitate is further used to control a primary recrystallized structure after strong cold rolling. A production technique established by modifying the above-described technique is disclosed in Japanese Examined Patent Publication (Kokoku) No. 54-13846. This modified technique includes the step of holding the steel sheet at a temperature in the range of from 50° to 350° C. in a period between passes in the cold rolling.

The technique disclosed in Japanese Examined Patent Publication (Kokoku) No. 40-15644 has the following problem. When the Si content is increased for the purpose of lowering the iron loss of the product, as described in Japanese Examined Patent Publication (Kokoku) No. 61-60896, a linear recrystallized grain defect occurs in the product, so that it becomes impossible to obtain a product having a high magnetic flux density. Further, as disclosed in Japanese Unexamined Patent Publication (Kokai) No. 48-51852, the occurrence of the $\alpha \rightarrow \gamma$ transformation is essential to the technique disclosed in Japanese Examined Patent Publication (Kokoku) No. 40-15644. Therefore, when the Si content is increased, it is necessary to increase the C content. Further, this makes it necessary to conduct hot rolling at a high temperature. For this reason, there is a limitation on the increase in the Si content. Techniques for solving such a problem have been proposed in Japanese Examined Patent Publication (Kokoku) Nos. 61-60896 and 62-45285.

Japanese Unexamined Patent Publication (Kokai) No. 56-13433 discloses that the C content of the steel is limited to 0.02% or less for the purpose of improving the cold rollability of the silicon steel sheet. In this publication, there is a description to the effect that the C content should be as low as possible from the viewpoint of improving the cold rollability and a reduction in the C content to 0.004% or less is recommended. In the conventional techniques for the production of a unidirectional electromagnetic steel sheet, the Si content of the steel is 4.8% at the highest.

As well known in the art, when the Si content becomes about 6.5%, the magnetic permeability of the product becomes so high that the steel exhibits excellent magnetic properties. Although the grain-oriented electrical steel sheet having a Si content of 6.5% is expected as a future material, the disclosure on the production techniques for this steel product is minimal.

DISCLOSURE OF INVENTION

An object of the present invention is to provide, with respect to a high (5 to 7.1%) silicon steel which has been considered difficult to conduct secondary recrystallization, a grain-oriented electrical steel sheet having a Si content of 5 to 7.1% through a combination of a technique for conducting the secondary recrystallization in a high degree of orientation with a technique for cold-rolling a high (5 to 7.1%) Si steel which has been difficult to cold-roll because of its high fragility, and a process for producing the same.

In the present invention, in order to attain the above-mentioned object, the cold rollability is remarkably improved by specifying the steel components and the rolling temperature in the cold rolling, and nitriding is conducted in a period between the decarburization annealing and the finish annealing to sufficiently precipitate secondary recrystallized grains. This enables a final unidirectional electromagnetic steel sheet having a high Si content of 6.5% and excellent magnetic properties to be produced.

Specifically, according to one aspect of the present invention, there is provided an ultrahigh silicon, grain-oriented electromagnetic steel sheet having a magnetic flux density, $B_8$, of 1.57 or more in a magnetized state at 50 Hz, comprising by weight 5 to 7.1% of Si with the balance consisting essentially of Fe and having a final thickness regulated by rolling and a secondary recrystallized structure having a degree of azimuth orientation, R ($B_8/B_s$), of 0.87 or more.

According to another aspect of the present invention, there is provided a process for producing an ultrahigh silicon grain-oriented electrical steel sheet, comprising cold-rolling an ultrahigh silicon steel sheet comprising by weight 0.005 to 0.023% of C, 5 to 7.1% of Si, 0.014% or less of S, 0.013 to 0.055% of acid soluble Al and 0.0095% or less of total N with the balance consisting of Fe and unavoidable impurities at a temperature in the range of from 120 to 380° C. optionally after annealing at a temperature in the range of from 800° to 1100° C., subjecting the cold-rolled sheet to decarburization annealing, coating the annealed sheet with an annealing separator and coiling the coated sheet to prepare a strip coil and subjecting the strip coil to high-temperature finish annealing for secondary recrystallization, wherein the steel sheet being subjected to nitriding during a period from the decarburization annealing to the initiation of secondary recrystallization in the high-temperature finish annealing to increase the nitrogen content.

BEST MODE FOR CARRYING OUT THE INVENTION

The best mode for carrying out the invention will now be described with reference to the drawings.

The iron loss usually decreases with an increase of the Si content. In particular, it has been proved through the use of a non-oriented electrical steel sheet or the like that since the magnetic strain becomes minimum when the Si content is around 6.5%, this steel is conveniently used in an iron core for a transformer because of its lower noise. (J. Appl. phys. vol. 64, No. 10 (1988) P. 5376).

The present inventors have studied the above ultrahigh silicon grain-oriented electrical steel sheet and, as a result, have found that the iron loss at the time of magnetization in the direction of rolling can be improved by enhancing the degree of azimuth integration of the crystal grain through the regulation of texture of the above-mentioned steel having a high Si content by secondary recrystallization.

The ultrahigh silicon grain-oriented electrical steel sheet of the present invention has a high degree of azimuth integration of the crystal grain and exhibits a better iron loss property than the conventional electromagnetic steel sheet in the same thickness.

Figure 1:
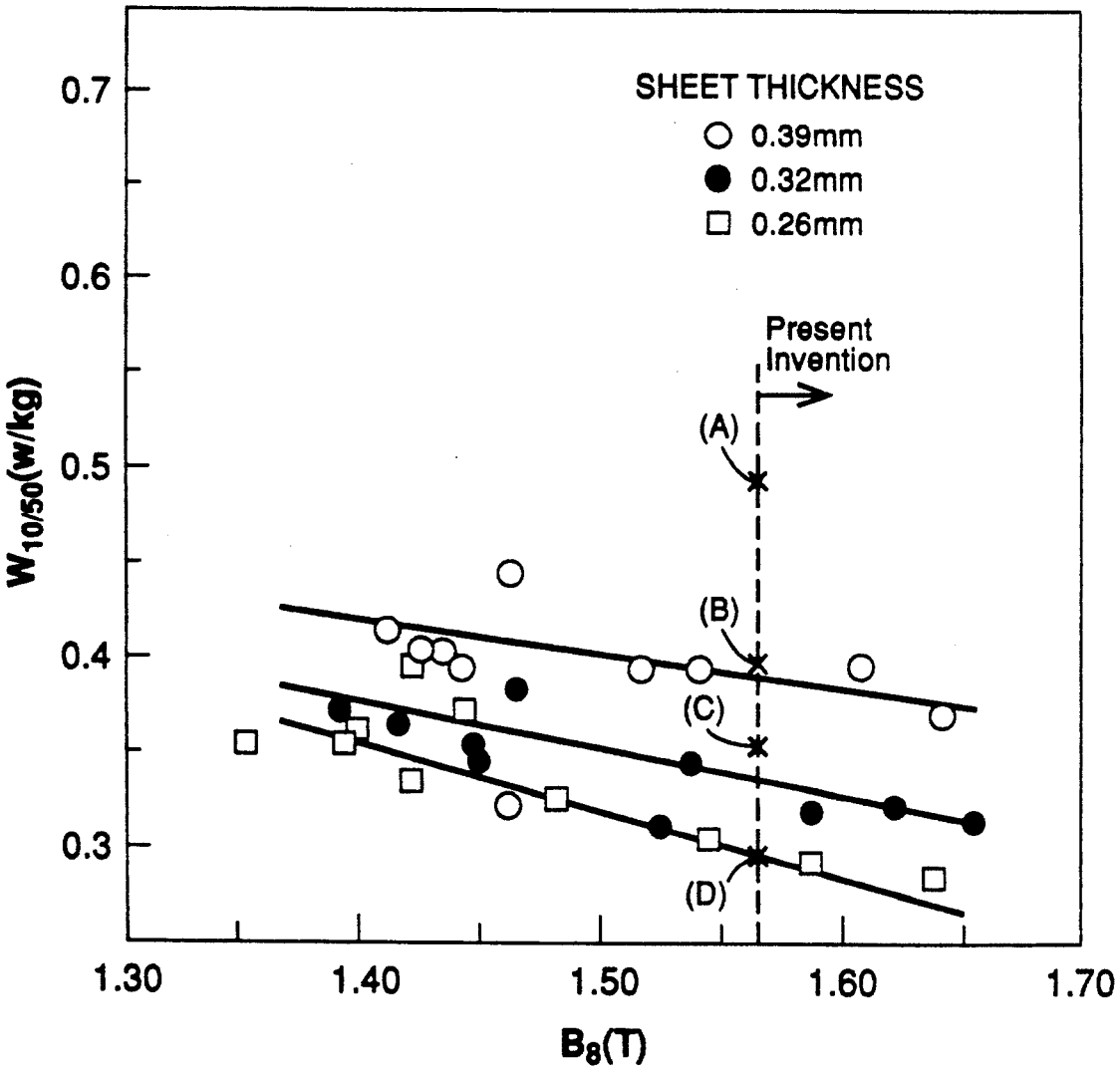
FIG. 1 is a graph showing the relationship between the iron loss value, $W_{10/50}$, and the magnetic flux density, $B_8$ (T) with respect to a grain-oriented electrical steel sheet having a Si content of 6.5%.

FIG. 1 is a graph showing the relationship between the iron loss value, $W_{10/50}$, and the magnetic flux density, $B_8$ (T), with respect to a grain-oriented electrical steel sheet having a Si content of 6.5%. As shown in the drawing, according to the present invention, a product having a thickness of 0.32 mm has such a high degree of azimuth orientation that the magnetic flux density ($B_8$ value) is $B_8 > 1.57T$, that is, $B_8/B_s > 0.87$, wherein $B_s$ represents a saturated magnetic flux density. The iron loss value, $W_{10/50}$, in this case is as small as 0.33 w/kg. This shows that the grain-oriented electrical steel sheet having a Si content of 5 to 7.1% and a secondary recrystallized grain structure is quite a novel soft magnetic material.

The $W_{10/50}$ value of a grain-oriented electrical steel sheet having a Si content of 3% and a thickness of 0.03 mm and the $W_{10/50}$ value of a non-oriented electromagnetic steel sheet having a Si content of 6.5% and a thickness of 0.30 mm are 0.35 w/kg (point (C) in the drawing) and 0.50 w/kg (point (A) in the drawing), respectively. From this fact, it can be understood that the grain-oriented electrical steel sheet having a Si content of 5 to 7.1% and a secondary recrystallized grain structure according to the present invention has a high degree of azimuth orientation which could not have been attained in the art. Point (B) in the drawing and point (D) in the drawing represent the $W_{10/50}$ value of a grain-oriented electrical steel sheet having a Si content of 3% and a thickness of 0.40 mm and the $W_{10/50}$ value of a grain-oriented electrical steel sheet having a Si content of 3% and a thickness of 0.25 mm, respectively.

The technical means for producing the above-mentioned grain-oriented electrical steel sheet having a Si content of 5 to 7.1% and an excellent azimuth orientation structure will now be described in detail.

In the grain-oriented electrical steel sheet having a Si content of 5 to 7.1%, the steel sheet is warm-rolled to a final sheet thickness without siliconizing in the course of the rolling process, therefore the configuration (evenness) of the product is good and the space factor can be increased when the product is laminated to prepare an iron core for a transformer etc., thus enabling the building factor of the transformer etc. to be reduced.

The basic constituent feature characteristic of the present invention is based on nitriding a steel sheet conducted in any of the steps of primary recrystallization annealing after the final cold rolling or the subsequent step of additional annealing, or the stage of raising the temperature before the development of the secondary recrystallization in the step of finish annealing at a high temperature for secondary recrystallization and purification of the steel, thereby forming an inhibitor necessary for the secondary recrystallization, and resides in a combination of two conditions, that is, a condition with respect to the cold rolling temperature and C content of the material which enables the steel sheet to be cold-rolled, with a condition with respect to the C content of the material and the cold rolling temperature which enables a product having a high magnetic flux density to be produced.

In order to investigate the relationship between the C content of the material and the cold rolling temperature, the present inventors have conducted the following experiment.

At the outset, a molten steel comprising 6.58% of Si, 0.003% of S and 0.0065% of total N was divided into seven, and their carbon contents were regulated to 0.001%, 0.005%, 0.009%, 0.020%, 0.026%, 0.037% and 0.056%, respectively, followed by casting into seven slabs. The slabs were heated to 1200° C., hot-rolled into hot-rolled sheets having a thickness of 2.0 mm, subjected to annealing at 1000° C. for 2 min and cold-rolled into steel sheets having a thickness of 0.2 mm. In the cold rolling, the draft per pass was in the range of from 10 to 20%, and the rolling temperature varied in the range of from room temperature (23° C.) to 400° C. as shown in FIG. 2.

The resultant cold-rolled sheets were subjected to decarburization annealing in a humid hydrogen atmosphere, subject to nitriding in ammonia-containing atmosphere for a nitrogen content increase of about 30 ppm, coated with an annealing separator composed mainly of MgO, and then subjected to high-temperature finish annealing at 1200° C. for 10 hr for secondary recrystallization and purification of the steel.

Figure 2:
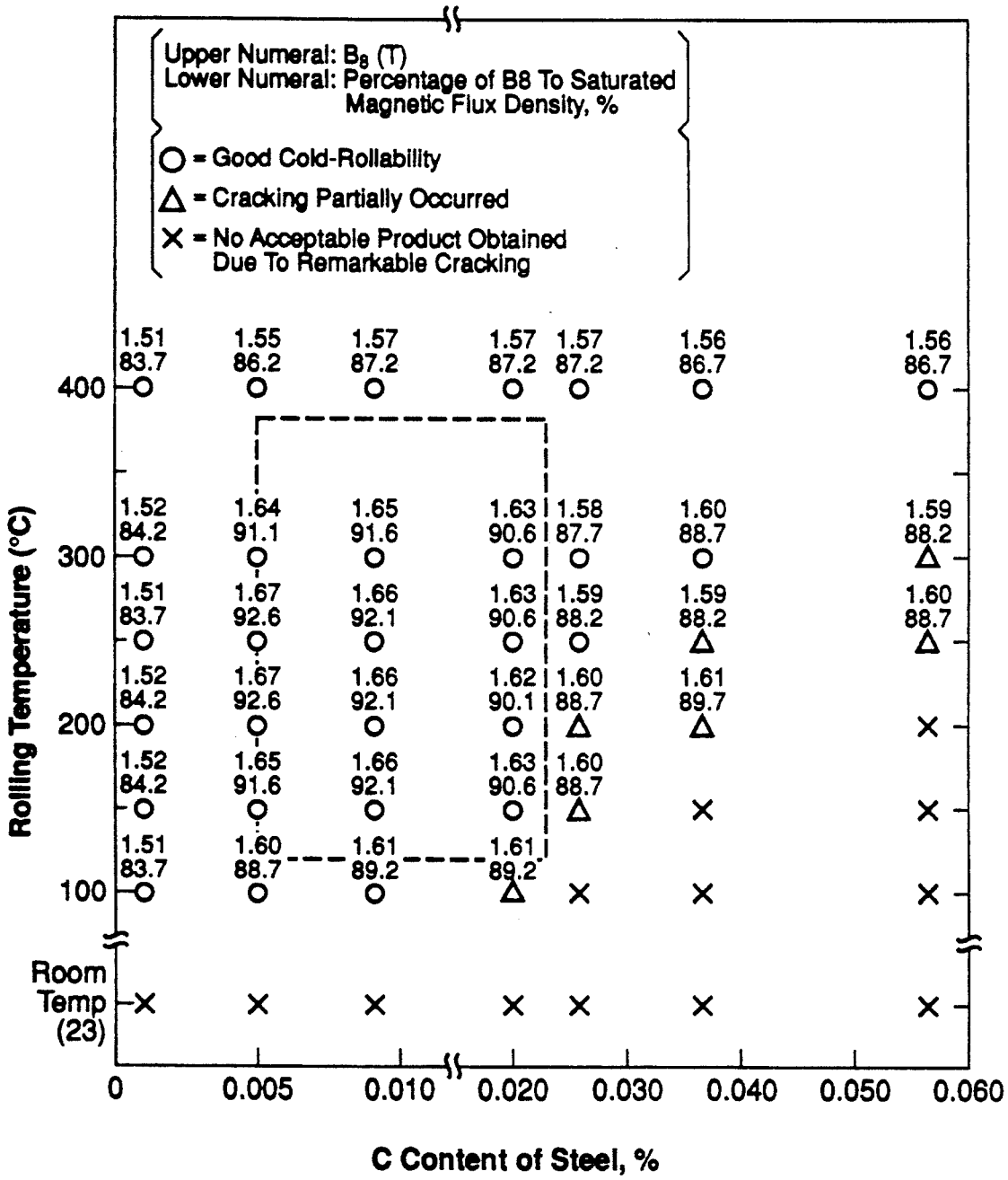
FIG. 2 is a diagram showing the effect of the cold rolling temperature and the C content of the steel on the cold rolling cracking and the magnetic flux density, $B_8$ (T).

The relationship between the occurrence of "cracking" of the material during cold rolling of the steel sheets under the above-mentioned conditions and the magnetic flux density ($B_8$ value) of the products is shown in FIG. 2 wherein the upper numeral represents the $B_8$ value. The saturated magnetic flux density of an electrical steel having a Si content Of about 3% generally known in art is 2.03T, while the saturated magnetic flux density of a steel having a Si content of 6.5% is 1.80T. At first sight, the $B_8$ values in FIG. 2 seem to be low. In order to demonstrate that the level of the $B_8$ values is much higher than the saturated magnetic flux density, the ratio (%) of the $B_8$ value to the saturated magnetic flux density is given as the lower numeral in FIG. 2. Grain-oriented electrical steel sheets commonly used in the art and specified as a grain-oriented electrical steel sheet having a high magnetic flux density in the current JIS standards have a $B_8$ value of about 1.92T which corresponds to 94.6% of the saturated magnetic flux density, while conventional grain-oriented electrical steel sheets have a $B_8$ value of 1.85T which corresponds to 91.1% of the saturated magnetic flux density. Therefore, grain-oriented electrical steel sheets having a $B_8$ value of 91.1 to 94.6% of the saturated magnetic flux density are contemplated.

From FIG. 2, it is apparent that the problem of "cracking" during cold rolling of a steel having a Si content of 6.5% can be alleviated by increasing the rolling temperature, and the critical temperature of the generation of the "cracking" increases with an increase in the C content of the steel. When the rolling temperature is excessively low or the C content of the steel is excessively high from the viewpoint of the cold rollability, however, as is apparent from FIG. 2, it is impossible to prepare a product having a high magnetic flux density.

In the present invention, the rolling temperature and the C content should fall within an area surrounded by a dotted line shown in FIG. 2. In this area, it becomes possible to prepare an excellent grain-oriented electrical steel sheet having a $B_8$ value of 90% or more of the saturated magnetic flux density, a good cold rollability and a minimized magnetic strain.

The present invention will now be described in more detail and in conformity with the constituent features.

Although there is no particular limitation on the process for producing the molten steel used in the present invention, the contents of the components should fall within the following respective ranges.

Si may be contained in an amount of 6.5% with some range of allowance from the viewpoint of the object of the present invention, that is, from the viewpoint of establishing a process which enables an iron having a Si content of about 6.5% capable of minimizing the magnetic strain to be produced on a commercial scale. The lower limit of the Si content is 5% because a steel having a Si content of less than 5% is not commercially available. This Si content is preferably close to 6.5% as much as possible from the viewpoint of the object of the present invention.

The upper limit of the Si content is 7.1%. When Si is incorporated in an amount exceeding 7.1%, the cold rollability deteriorates significantly and the magnetic properties of the product are poor.

In the present invention, the C content capable of providing the highest magnetic flux density ($B_8$ value) is about 0.012%. The effect of improving the magnetic flux density ($B_8$ value) appears when the C content is 0.005% or more. When the C content is excessively high, there is a tendency for the cold rollability to deteriorate and the magnetic flux density ($B_8$ value) becomes poor. In the present invention, the C content should be in the range of from 0.005 to 0.023 by taking the cold rollability as well into consideration. When the C content is in this range, no $\alpha$-$\gamma$ transformation occurs if the Si content falls within the range specified in the present invention.

When the S content exceeds 0.014%, there occurs linear secondary recrystallization defect regions in the rolling direction.

The content of the acid soluble Al is limited to 0.013 to 0.055% from the viewpoint of forming an inhibitor necessary for the development of secondary recrystallization.

When the total N content is excessively high, a bulgy defect called "blister" occurs on the surface of the steel sheet. When the content exceeds 0.0095%, the frequency of the occurrence of the blister becomes so high that no acceptable product can be obtained.

A slab having the above-mentioned composition is hot-rolled into a sheet. In this case, when the slab heating temperature is excessively high, the magnetic flux density ($B_8$ value) of the product begins to drop. Further, the consumption of heating energy becomes large, and the frequency of repair of the heating oven becomes so high that the maintenance cost becomes high and, at the same time, the working cost increases due to the lowering in the operating efficiency of he equipment. When the slab heating temperature is 1270° C. or below, there occurs neither deflection of the slab nor slag at the time of heating, so that no increase in the working cost occurs. Further, in the present invention, when a molten steel is cast into a thin strip having a thickness of about 2.3 mm, it is possible to use a process wherein the step of hot rolling is omitted.

A product having a high magnetic flux density ($B_8$ value) can be obtained by annealing the hot-rolled sheet or thin cast strip at a temperature in the range of from 800° to 1100° C. When the annealing temperature is low, the annealing is conducted for a long period of time, while when the annealing temperature is high, the annealing is conducted for a short period of time. Although this annealing can enhance the magnetic flux density of the product, it increases the production cost. Therefore, the adoption of the annealing may be determined according to magnetic properties required of the product.

The material is then cold-rolled. In this case, when the rolling temperature is excessively low, the material is vulnerable to "cracking". On the other hand, when the rolling temperature is excessively high, the magnetic flux density ($B_8$ value) of the product deteriorates. For this reason, in the present invention, the rolling temperature should be in the range of from 120° to 380° C., which can satisfy both the above requirements.

When the cold rolling is conducted with a draft in the range of from 80 to 94%, it is possible to prepare a product having a high magnetic flux density, when the draft is about 90%, the highest magnetic flux density can be obtained.

The resultant cold-rolled sheet is subjected to decarburization annealing in a humid hydrogen atmosphere for the purpose of conducting primary recrystallization and reducing the C content of the steel. After the decarburization annealing, the material is coated with an annealing separator.

Thereafter, the material is subjected to high-temperature finish annealing or the purpose of conducting secondary recrystallization and purifying the steel.

In the present invention, it is necessary to form a nitride (an inhibitor) necessary for the secondary recrystallization by making use of any one of a combination of methods wherein the steel sheet (strip) after the decarburization annealing is annealed for a short period of time in an atmosphere having the capability of nitriding the steel sheet and a method wherein a nitriding treatment is conducted in a period between the decarburization annealing and the initiation of the secondary recrystallization in the stage of raising the temperature in the step of high-temperature finish annealing. When the nitride (inhibitor) is formed by the latter method, in many cases, the steel sheet (strip) is subjected to the high-temperature finish annealing in the form of a strip coil. Therefore, it is difficult to conduct the nitriding in an annealing atmosphere in the step of high-temperature finish annealing from the viewpoint of homogeneous nitriding through the strip coil. In this case, the addition of a compound having the capability of nitriding the steel to the annealing separator is useful for attaining homogeneous nitriding.

EXAMPLES

EXAMPLE 1

A molten steel comprising 6.53% of Si, 0.006% of S, 0.023% of acid soluble Al and 0.0065% of total N was divided into three, and their carbon contents were regulated to 0.002%, 0.010% and 0.047%, respectively, followed by casting into three slabs. The slabs were heated to 1230° C., hot-rolled into hot-rolled sheets having a thickness of 2.0 mm, subjected to annealing at 1000° C. for 2 min and col-rolled into steel sheets having a thickness of 0.2 mm. The cold rolling was conducted in about 12 passes with the sheet temperature being varied to 80° C., 220° C. and 400° C. The cold-rolled sheets were subjected to decarburization annealing in a humid hydrogen atmosphere, subjected to a nitriding treatment in an ammonia atmosphere to increase the nitrogen content by about 300 ppm, coated with MgO as an annealing separator, and subjected to high-temperature annealing at 1200° C. for 10 hr for the purpose of conducting secondary recrystallization and purification of the steel. The state of occurrence of cracking during the cold rolling and the magnetic flux density of the resultant products are given in Table 1.

TABLE 1

| | Rolling temp. | | | | | |
|---|---|---|---|---|---|---|
| | 80° C. | | 220° C. | | 400° C. | |
| | Properties | | | | | |
| C (%) of steel | Cracking during cold rolling | $B_8$ (T) R* | Cracking during cold rolling | $B_8$ (T) R* | Cracking during cold rolling | $B_8$ (T) R* |
| 0.002 | free | 1.52<br>84.2 | free | 1.53<br>84.7 | free | 1.51<br>83.7 |
| 0.010 | slight cracking occurred | 1.55<br>86.2 | free | 1.65<br>91.6 | free | 1.57<br>87.2 |
| 0.047 | Unrollable | — | unrollable | — | free | 1.56<br>86.7 |

Note)
*R: Percentage of $B_8$ to saturated magnetic flux density, %

Although all the steels having a carbon content of 0.002% could be rolled at any of the rolling temperatures, the $B_8$ value unfavorably was low. The steels having a C content of 0.047 % were unrollable at 80° C. and 220° C., and although they could be successfully rolled at 400° C., the $B_8$ value was poor. By contrast, all the steels falling within the scope of the present invention which had a C content of 0.010% and rolled at a temperature of 220° C. were free from cracking and exhibited an excellent $B_8$ value.

EXAMPLE 2

A molten steel comprising 6.55% of Si, 0.012% of C, 0.005% of S and 0.0065% of total N was divided into three, and their acid soluble Al contents were regulated to 0.005%, 0.026% and 0.059%, respectively, followed by casting into three slabs. The slabs were heated to 1230° C., hot-rolled into ho-rolled sheets having a thickness of 2.0 mm, subjected to annealing at 1000° C. for 2 min and cold-rolled at 80° C., 220° C. and 400° C. into steel sheets having a thickness of 0.2 mm. The cold-rolled sheets were subjected to decarburization annealing in a humid hydrogen atmosphere, subjected to a nitriding treatment in an ammonia atmosphere to increase the nitrogen content by about 300 ppm, coated with MgO as an annealing separator, and subjected to high-temperature annealing at 1200° C. for 10 hr for the purpose of conducting secondary recrystallization and purification of the steel. The magnetic flux density of the resultant products are given in Table 2.

TABLE 2

| Al (%) of steel | Rolling temp. 80° C. Cracking during cold rolling | 80° C. $B_8$ (T) R* | 220° C. Cracking during cold rolling | 220° C. $B_8$ (T) R* | 400° C. Cracking during cold rolling | 400° C. $B_8$ (T) R* |
|---|---|---|---|---|---|---|
| 0.005 | slight cracking occurred | no secondary recrystallization occurred | free | no secondary recrystallization occurred | free | no secondary recrystallization occurred |
| 0.026 | slight cracking occurred | 1.60 88.7 | free | 1.66 92.1 | free | 1.58 87.7 |
| 0.059 | slight cracking occurred | no secondary recrystallization occurred | free | no secondary recrystallization occurred | free | no secondary recrystallization occurred |

Note)
*R: Percentage of $B_8$ to saturated magnetic flux density, %

The steels respectively having Al contents of 0.005% and 0.059% which are outside the scope of the present invention exhibited no secondary recrystallization. On the other hand, the steel which and an Al content of 0.026% and was rolled at a temperature of 220° C., that is, falls within the scope of the present invention, exhibited no cracking and a good $B_8$ value.

EXAMPLE 3

With respect to the sheets used in Example 2 which had been subjected to decarburization annealing, one of them was used as it was, and the other sheet was nitrided in an ammonia atmosphere to increase the N content by about 300 ppm. These two types of sheets were coated with (A) MgO or (B) MgO+5% ferromanganese nitride as the annealing separator and then subjected to high-temperature finish annealing at 1200° C. for 10 hr for the purpose of conducting secondary recrystallization and purification of the steel.

The magnetic flux density of the resultant products and the state of occurrence of secondary recrystallization are given in Table 3.

TABLE 3

| Ammonia nitriding | | Annealing release agent | Properties of product: Secondary recrystallization | $B_8$ (T) R* |
|---|---|---|---|---|
| not conducted | (A) | MgO | no secondary recrystallization occurred | 1.36 75.4 |
| | (B) | MgO + 5% ferromanganese nitride | good | 1.64 91.1 |
| conducted (300 ppm increase of nitrogen) | (A) | MgO | good | 1.66 92.1 |
| | (B) | Mgo + 5% ferromanganese nitride | good | 1.67 92.6 |

Note)
*R: Percentage of $B_8$ to saturated magnetic flux density, %

A secondary recrystallized grain having a high $B_8$ value could always be obtained when the sheet subjected to decarburization annealing was nitrided in an ammonia atmosphere, when ferromanganese nitride having a capability of nitriding the steel was added to the annealing separator, and when use was made of a combination of both the above-mentioned methods.

EXAMPLE 4

A molten steel comprising 0.014% of C, 0.007% of S, 0.029% of acid soluble Al and 0.0075% of total N was divided into three, and their Si contents were regulated to 5.20%, 6.53% and 7.56%, respectively, followed by casting into three slabs. The slabs were heated to 1150° C. and hot-rolled into hot-rolled sheets having a thickness of 2.0 mm. With respect to these hot-rolled sheets, one of them was directly cold-rolled into a sheet having a thickness of 0.2 mm, and another hot-rolled sheet was annealed at 1000° C. for 2 min and then cold-rolled into a sheet having a thickness of 0.2 mm. The cold rolling was conducted at a sheet temperature of 270° C. in about 14 passes. The cold-rolled sheets were subjected to decarburization annealing in a humid hydrogen atmosphere, subjected to a nitriding treatment in an ammonia atmosphere to increase the nitrogen content by about 100 ppm, coated with (5% ferromanganese nitride +MgO) as an annealing separator, and subjected to high-temperature finish annealing at 1200° C. for 10 hr for the purpose of conducting secondary recrystallization and purification of the steel. The state of occurrence of cracking during the cold rolling and the magnetic flux density of the resultant products are given in Table 4.

TABLE 4

| Si content (%) of steel | Properties: Cracking during cold rolling | $B_8$ (T) R* |
|---|---|---|
| 5.20 | Free | 1.72 92.6 |
| 6.53 | Free | 1.66 92.1 |
| 7.56 | slight cracking occurred | 1.53 87.7 |

Note)
*R: Percentage of $B_8$ to saturated magnetic flux density, %

The degree of orientation derived from the secondary recrystallization of the material having a Si content of 7.56% was slightly inferior to that of the material having a Si content of 5.20% and the material having a Si content of 6.53%.

INDUSTRIAL APPLICABILITY

According to the present Invention, it is possible to produce a ultrahigh silicon, grain-oriented electrical steel sheet having a Si content of about 6.5% and excellent magnetic properties, especially a high magnetic permeability, a very low iron loss and very low magnetic strain, so that a transformer and other components less liable to energy loss and noise can be advantageously provided.

We claim:

1. A process for producing an ultrahigh silicon, grain-oriented electrical steel sheet, comprising cold-rolling an ultrahigh silicon steel sheet comprising by weight 0.005 to 0.023% of C, 5 to 7.1% of Si, 0.014% or less of S, 0.013 to 0.055% of acid soluble Al and 0.0095% or less of total N with the balance consisting of Fe and unavoidable impurities at a temperature in the range of from 120° to 380° C., subjecting the cold-rolled sheet to decarburization annealing, coating the annealed sheet with an annealing separator, coiling the coated sheet to prepare a strip coil and then subjecting the strip coil to high-temperature finish annealing for secondary recrystallization, wherein the steel sheet being subjected to nitriding during a period from after the decarburization annealing to the initiation of secondary recrystallization in the high-temperature finish annealing, to increase the nitrogen content.

2. The process according to claim 1 wherein the ultrahigh silicon steel sheet before the rolling is a hot-rolled sheet.

3. The process according to claim 1 wherein the ultrahigh silicon steel sheet before the cold rolling is a cast strip produced by continuous casting.

4. The process according to claim 1 wherein said ultrahigh steel sheet is cold-rolled after annealing at a temperature in the range of from 800° to 1100° C.

* * * * *

UNITED STATES PATENT AND TRADEMARK OFFICE

CERTIFICATE OF CORRECTION

PATENT NO. : 5,308,411

DATED : May 3, 1994

INVENTOR(S) : Yozo SUGA, et al.

It is certified that error appears in the above-indentified patent and that said Letters Patent is hereby corrected as shown below:

On the Title Page, item [54] and Column 1, line 2, change "Proces" to --Process--.

Column 3, line 27, change "being" to --is--.

Column 5, line 24, change "Of" to --of--.

Column 6, line 47, change "he equipment." to --the equipment--.

Column 8, line 4, change "col-rolled" to --cold-rolled--

Column 8, line 56, change "ho-rolled" to --hot-rolled--.

Column 9, line 20, change "and" to --had--.

Column 9, line 45, move "recrystallization occurred" to appear under column headed "Secondary recrystallization" and move "75.4" to appear under column headed "$B_8$(T)".

UNITED STATES PATENT AND TRADEMARK OFFICE

CERTIFICATE OF CORRECTION

PATENT NO. : 5,308,411

DATED : May 3, 1994

INVENTOR(S) : Yozo SUGA, et al.

It is certified that error appears in the above-identified patent and that said Letters Patent is hereby corrected as shown below:

Column 10, line 57, change "a" to --an--.

Column 12, line 4, between "the" and "rolling" insert --cold--.

Signed and Sealed this

Thirteenth Day of September, 1994

*Attest:*

*Attesting Officer*

BRUCE LEHMAN

*Commissioner of Patents and Trademarks*